US008820016B2

(12) United States Patent
Zhou et al.

(10) Patent No.: US 8,820,016 B2
(45) Date of Patent: Sep. 2, 2014

(54) EXTERNAL INSULATION WALL HAVING GRID-REINFORCED INSULATION BOARD MECHANICALLY ANCHORED

(75) Inventors: Jinlie Zhou, Shanghai (CN); Yue Zhou, Shanghai (CN)

(73) Assignee: Shanghai One Gold Energy-Saving Technology Co., Ltd, Shanghai (CN)

( * ) Notice: Subject to any disclaimer, the term of this patent is extended or adjusted under 35 U.S.C. 154(b) by 0 days.

(21) Appl. No.: 13/814,498

(22) PCT Filed: Jul. 29, 2011

(86) PCT No.: PCT/CN2011/077779

§ 371 (c)(1), (2), (4) Date: Feb. 5, 2013

(87) PCT Pub. No.: WO2012/016502

PCT Pub. Date: Feb. 9, 2012

(65) Prior Publication Data

US 2013/0125489 A1 May 23, 2013

(30) Foreign Application Priority Data

| | | |
|---|---|---|
| Aug. 6, 2010 | (CN) | 2010 2 0283552 U |
| Sep. 28, 2010 | (CN) | 2010 2 0545219 U |
| Oct. 9, 2010 | (CN) | 2010 2 0553659 U |
| Oct. 9, 2010 | (CN) | 2010 2 0553668 U |
| Nov. 3, 2010 | (CN) | 2010 2 0591074 U |

(51) Int. Cl.

| | |
|---|---|
| ***E04B 1/74*** | (2006.01) |
| ***E04B 2/02*** | (2006.01) |
| ***E04B 1/76*** | (2006.01) |

(52) U.S. Cl.

CPC . *E04B 2/02* (2013.01); *E04B 1/762* (2013.01); *E04B 1/7633* (2013.01)

USPC ..... 52/407.4; 52/404.2; 52/506.05

(58) Field of Classification Search

USPC ..... 52/169.5, 169.11, 294, 404.2, 407.4, 52/506.02, 506.05, 388

See application file for complete search history.

(56) References Cited

U.S. PATENT DOCUMENTS

| | | | | |
|---|---|---|---|---|
| 2,889,698 | A * | 6/1959 | Stevens | 52/410 |
| 3,401,494 | A * | 9/1968 | Anderson | 52/309.2 |
| 4,875,322 | A * | 10/1989 | Rozzi | 52/746.1 |
| 4,947,600 | A * | 8/1990 | Porter | 52/235 |
| 5,979,131 | A * | 11/1999 | Remmele et al. | 52/309.9 |
| 6,725,616 | B1 * | 4/2004 | Pease | 52/309.7 |
| 7,067,588 | B2 * | 6/2006 | Ritter et al. | 525/268 |
| 7,958,687 | B2 * | 6/2011 | Dilorenzo | 52/319 |

* cited by examiner

*Primary Examiner* — Brian Glessner
*Assistant Examiner* — Adam Barlow

(57) ABSTRACT

An external insulation wall having grid-reinforced insulation board anchored with mechanical devices includes: a base course wall (1), wherein a leveling and bonding layer (2), grid-reinforced insulation boards (3), plastic expansion anchor bolts (4), a thin plaster protecting layer (5), and a finishing layer (6) are provided on the base course wall (1) from inside to outside in turn. Holes are dilled on the grid-reinforced insulation boards (3), and the grid-reinforced insulation boards (3) are directly fixed on the base course wall with the plastic expansion anchor bolts (4), in such a manner that all load of an external insulation system is born by the plastic expansion anchor bolts (4), and the plastic expansion anchor bolts (4) transmits the load to the base course wall (1). The external insulation wall can solve technical problems of low bearing capacity and difficult surface treatment caused by an old base course wall.

12 Claims, 1 Drawing Sheet

EXTERNAL INSULATION WALL HAVING GRID-REINFORCED INSULATION BOARD MECHANICALLY ANCHORED

CROSS REFERENCE OF RELATED APPLICATION

This is a U.S. National Stage under 35 U.S.C 371 of the International Application PCT/CN2011/077779, filed Jul. 29, 2011, which claims priority under 35 U.S.C. 119(a-d) to CN 201020283552.5, filed Aug. 6, 2010, CN 201020545219.7, filed Sep. 28, 2010, CN 201020553668.6, filed Oct. 9, 2010, CN 201020553659.7, filed Oct. 9, 2010, and CN 201020591074.45, filed Nov. 3, 2010.

BACKGROUND OF THE PRESENT INVENTION

1. Field of Invention

The present invention relates to an external insulation wall for an external wall, which comprises grid-reinforced insulation boards mechanically anchored by mechanical fixing devices, and more particularly to the external insulation wall for an external wall energy-saving renovation project of an existing building.

2. Description of Related Arts

The conventional external insulation wall having the insulation board mechanically anchored is a composite wall comprising a base course wall and an insulation board. Because of the low tensile strength and the low flexural strength of the insulation board, a steel wire mesh or a glass fiber mesh cloth is usually adopted to strengthen the surface of the insulation board. This structure requires a spacer provided between the steel wire mesh and the surface of the insulation board when the insulation board is fixed, in such a manner that a certain distance exists between the steel wire mesh and the insulation board. Meanwhile, the steel wire mesh and the insulation board are directly fixed on the structure wall, and then both sides of the steel wire mesh are powdered to form 20 mm-thick leveling layers. If the glass fiber mesh cloth is utilized to strengthen the surface of the insulation board, a leveling layer of polymer mortar is firstly applied to the surface of the insulation board, then the glass fiber mesh cloth is buried in the leveling layer, and finally a layer of polymer anti-cracking mortar is applied to the surface of the glass fiber mesh cloth.

However, because of the low peel strength of the insulation board, the above method of adding the leveling layer will directly cause the increment of the load of the external wall insulation board layer. In addition, defects of shifting and unflatness easily occurs in the on-site construction of the steel wire mesh and the glass fiber mesh cloth, which possibly leaves potential dangers of quality, security and stability for the whole external insulation wall. Therefore, the fixing method of the external wall insulation board is required to be improved.

SUMMARY OF THE PRESENT INVENTION

In order to overcome a shortcoming that the conventional fixing method possibly leaves potential dangers of quality, security and stability by utilizing an anchoring fixer and a steel wire mesh or a glass fiber mesh cloth to fix an external insulation wall having the insulation board mechanically anchored, the present invention provides an external insulation wall having grid-reinforced insulation boards anchored by mechanical fixing devices, wherein the external insulation wall can not only solve a problem of quality, security and stability possibly caused by adding a leveling layer load, but also significantly increase a tensile strength and a flexural strength of the insulation board. In addition, a construction technology is simple and convenient.

The technical solution for solving the technical problem of the present invention is as followed. A surface of a base course wall is applied with polymer mortar as a leveling and bonding layer. Meanwhile, insulation boards are immediately adhered to the surface of the base course wall to ensure the flatness of the insulation board, wherein two-dimensional grid reinforcers are provided in surface layers of the insulation board. The insulation board can be a rockwool insulation board, a glass wool insulation board, a slag wool insulation board, a polyurethane insulation board, a phenolic aldehyde insulation board or a modified expanded perlite insulation board, which is prefabricated in factories. According to the requirements, the grid reinforcer can be a two-dimensional glass fiber grid reinforcer, a metal wire grid reinforcer or a chemical fiber grid reinforce. Then holes are drilled on the grid-reinforced insulation board, and the grid-reinforced insulation board is directly fixed on a base course structure wall with plastic expansion anchor bolts. Finally an outer surface of the grid-reinforced insulation board is thinly plastered with a protecting layer anti-cracking mortar and rollingly painted with a finishing layer elastic coating.

The leveling and bonding layer has a thickness of 3~9 mm, which meets a thickness requirement of leveling and bonding. A spacing between the mechanical fixing devices, i.e., the plastic expansion anchor bolts, arranged parallelly in a longitudinal direction and a lateral direction is 200~450×200~450 mm, and an optimum spacing is 250~400×250~400 mm. A number of the anchor bolts is more than 8 per square meter. An effective anchoring depth of the plastic expansion anchor bolt is more than 25 mm, and an optimum anchoring depth is 35~45 mm. A diameter of the anchor bolt is more than 8 mm. A standard value of a tensile bearing capacity of a single anchor bolt is more than 0.6 KN. A diameter of a plastic disc platen having holes provided on an outer end portion of the anchor bolt is more than 60 mm, to ensure a stability of the insulation board.

The external insulation wall having the grid-reinforced insulation board mechanically anchored is characterized as followed. The surface of the base course wall is applied with the polymer mortar as the leveling and bonding layer. Meanwhile, insulation boards are immediately adhered to the surface of the base course wall to form a void-free insulation layer, wherein two-dimensional grid reinforcers are provided in a surface layer of the insulation board. The insulation boards are rectangle boards paved in a lateral direction, and vertical joints between the insulation boards are in a type of running bond. Then the holes are drilled on the grid-reinforced insulation boards for installing the plastic expansion anchor bolts, each of which comprises the plastic disc platen having holes provided on the outer end portion thereof, in such a manner that the grid-reinforced insulation boards are directly fixed on the base course wall.

The beneficial effects of the present invention are as followed. Compared to the conventional external insulation wall comprising the insulation board fixed by the anchoring fixer and the steel wire mesh, a leveling of the base course wall and an auxiliary bonding of the insulation board can be finished at one time with the leveling and bonding layer according to the present invention, in such a manner that a construction process and a construction period are reduced. The grid-reinforced insulation board is mechanically anchored with the mechanical fixing devices, in such a manner that a construction technology is simplified to decrease the cost, operations are convenient, and a construction quality is easily controlled.

A combination of the grid-reinforced insulation board and the anchor bolts significantly increases the tensile strength, the flexural strength and a stability of an insulation layer. The present invention is especially for an external insulation energy-saving renovation of an external wall of an existing building. The present invention can solve a problem of a low bond strength caused by partial peeling, cracks, surface contamination isolation membrane, etc. of an old base course wall, in such a manner that the old base course wall can be strengthened and protected, and the stability of the old base course wall can be increased.

BRIEF DESCRIPTION OF THE DRAWINGS

The specific characteristics and the performance of the present invention are further described in the following embodiments and drawings.

Figure 1:
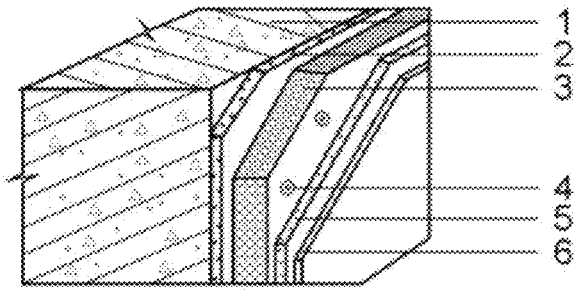
FIG. 1 is a structure sketch view of an external insulation wall having a grid-reinforced insulation board mechanically anchored according to a preferred embodiment of the present invention.

In the drawings: 1, base course wall; 2, leveling and bonding layer; 3, grid-reinforced insulation board; 4, plastic expansion anchor bolt; 5, thin plaster protecting layer; 6, finishing layer.

DETAILED DESCRIPTION OF THE PREFERRED EMBODIMENT

Referring to FIG. 1 of the drawings, an external insulation wall according to a preferred embodiment of the present invention comprises: a base course wall 1, a leveling and bonding layer 2, grid-reinforced insulation boards 3, plastic expansion anchor bolts 4, a thin plaster protecting layer 5 and a finishing layer 6 from inside to outside in turn. The base course wall 1 is a concrete wall, an aerated concrete block wall, a solid brick wall, a hollow brick wall or a lightweight cement sand block wall. The grid-reinforced insulation board 3 comprises an insulation board and grid reinforcers provided in a surface layer of the insulation board. The insulation board is a rockwool insulation board, a glass wool insulation board, a slag wool insulation board, a polyurethane insulation board, a phenolic aldehyde insulation board or a modified expanded perlite insulation board. The grid reinforcer is a glass fiber grid reinforcer, a metal steel wire grid reinforcer or a chemical fiber grid reinforcer, wherein the metal steel wire grid reinforcer comprises longitudinal steel wires and lateral steel wires intersecting and welded together, and the glass fiber grid reinforcer or the chemical fiber grid reinforcer is knitted up with intersecting glass fibers or chemical fibers. According to requirements, the grid reinforcers are provided in either surface layer or in both surface layers of the insulation board. The plastic expansion anchor bolt 4 is a beating type anchor bolt or a screw type anchor bolt. A plastic sleeve and a plastic disc platen having holes of the plastic expansion anchor bolt 4 are made of polyamide, polyethylene, or polypropylene. The thin plaster protecting layer 5 comprises a pastering anti-cracking mortar and an alkali-resistant glass fiber mesh cloth. The finishing layer 6 comprises a surface coating and an overlay coating.

Figure 2:
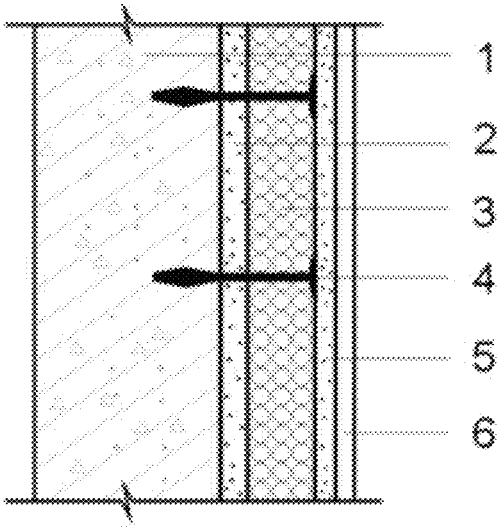
FIG. 2 is a longitudinal sectional structure view of FIG. 1.

Referring to FIG. 2, polymer mortar applied as the leveling and bonding layer 2 has a thickness of 3~9 mm. While the base course wall 1 is leveled, the grid-reinforced insulation boards 3 are adhered to the base course wall 1, and the surface layer which the grid reinforcer is provided in faces outwardly. After a bonding strength of the leveling and bonding layer 2 is more than 0.06 MPa, holes are drilled on the grid-reinforced insulation boards 3, and the grid-reinforced insulation boards 3 are fixed on the base course wall 1 with the plastic expansion anchor bolts 4. An effective anchoring depth of the plastic expansion anchor bolt 4 is more than 25 mm, and an optimum anchoring depth of the plastic expansion anchor bolt 4 is 35~45 mm. A diameter of the anchor bolt is more than 8 mm. A diameter of the plastic disc platen having holes is more than 60 mm, and an optimum diameter of the plastic disc platen having holes is 65~95 mm. Then the grid-reinforced insulation boards 3 are plastered with the thin plaster protecting layer 5, wherein the grid-reinforced insulation boards 3 are covered with the plastic expansion anchor bolts 4, in such a manner that an insulating layer is protected. The thin plaster protecting layer 5 is preferably polymer anti-cracking mortar comprising a reinforcing mesh playing roles of crack-resistant, waterproof and impact resistance. The thin plaster protecting layer 5 is plastered with the finishing layer 6, and flexible putty, resilient surface coating and resilient overlay coating are plastered layer by layer.

Figure 3:
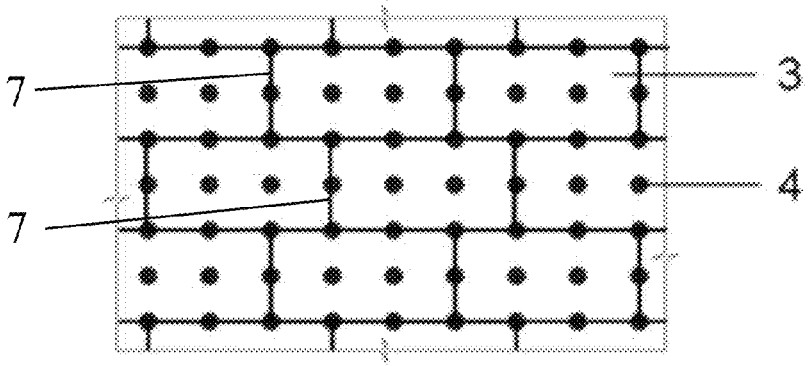
FIG. 3 is a front sketch view of the grid-reinforced insulation board mechanically anchored.

Referring to FIG. 3, the grid-reinforced insulation boards 3 are rectangle board paved in a lateral direction, and vertical joints 7 between the insulation boards are in a type of running bond. A staggered vertical joint 7 spacing is more than 250 mm, and an optimum staggered vertical joint 7 spacing is 300 mm or 400 mm, to make full use of the anchor bolts which is in the vertical joints 7 for fixing the insulation boards. A length of the grid-reinforced insulation board 3 is 800~2400 mm, and an optimum length is 900~1600 mm. A width of the grid-reinforced insulation board 3 is 400~1600 mm, and an optimum width is 600~1200 mm. The plastic expansion anchor bolts 4 are arranged on the grid-reinforced insulation boards 3 and in joints between the grid-reinforced insulation boards 3. An anchoring spacing between the plastic expansion anchor bolts, arranged parallelly in a longitudinal direction and a lateral direction is 200~450×200~450 mm, and an optimum anchoring spacing is 250~400×250~400 mm. A number of the anchor bolts in each vertical joint 7 is more than 3, and a spacing between the anchor bolts is less than 400 mm. The anchor bolts are provided at four angles of the insulation board. A number of the anchor bolts per square meter is more 8, in such a manner that a stability of insulation board is ensured.

In order to improve functions of energy saving and fire prevention of a building, the grid-reinforced insulation board having different performances can be chosen for construction according to different needs of the building in the present invention. A thermosetting grid-reinforced polyurethane insulation board or a thermosetting grid-reinforced phenolic insulation board having a thermal conductivity coefficient less than 0.027 w/(m.k) is chosen for an external insulation layer of an external wall of the building having a height less than 18 m. The grid-reinforced rockwool insulation board, the grid-reinforced glass wool insulation board, the grid-reinforced slag wool insulation board or the grid-reinforced modified expanded perlite insulation board made of Class A non-combustible material is chosen for the external insulation layer of the external wall of the building having the height more than 18 m. The several different materials can also be combined in use. A Class A non-combustible insulation board can be utilized as an external wall fire barrier. Fire prevention sub-warehouse are arranged along windows, doors, openings, Yin and Yang corners, etc., to prevent a flame propagation, to prevent a fire from spreading, and to ensure a safety use of the building.

What is claimed is:

1. An external insulation wall having grid-reinforced rockwool insulation board mechanically anchored, comprising: a base course wall, wherein a leveling and bonding layer, grid-reinforced rockwool insulation boards, plastic expansion anchor bolts, a thin plaster protecting layer, and a finishing layer are provided on said base course wall from inside to outside in turn;

a surface of said base course wall is applied with 3~9 mm thick polymer mortar as said leveling and bonding layer, and a leveling of said base course wall and an auxiliary bonding of said grid-reinforced rockwool insulation boards can be finished at one time to ensure a flatness of said grid-reinforced rockwool insulation boards;

then, said grid-reinforced rockwool insulation boards are adhered to said base course wall, wherein grid reinforcers are provided in a surface layer of each grid-reinforced rockwool insulation board, and said surface layer with said grid reinforcers inside faces outwardly, so as to form a void-free insulation layer, said grid-reinforced rockwool insulation boards are rectangle boards paved in a lateral direction, vertical joints between said grid-reinforced insulation boards are staggered, and an optimum staggered vertical joint spacing is 300 mm or 400 mm;

then said grid-reinforced rockwool insulation boards are anchored with mechanical fixing devices, wherein said mechanical fixing devices are said plastic expansion anchor bolts, which means that holes are drilled on said grid-reinforced rockwool insulation boards for installing said plastic expansion anchor bolts, wherein a plastic disc platen having holes is provided on an outer end portion of each said plastic expansion anchor bolt, in such a manner that said grid-reinforced rockwool insulation board is directly fixed on said base course wall;

finally, said grid-reinforced insulation boards are plastered with said thin plaster protecting layer, said grid-reinforced insulation boards are covered with said plastic expansion anchor bolts, in such a manner that an insulating layer is protected, said thin plaster protecting layer is made of polymer anti-cracking mortar comprising a reinforcing mesh playing roles of crack-resistant, waterproof and impact resistance;

said grid-reinforced rockwool insulation board has a length of 800~2400 mm and a width of 400~1600 mm; said plastic expansion anchor bolts are arranged on said grid-reinforced rockwool insulation boards and in joints between said grid-reinforced rockwool insulation boards, an anchoring spacing between said plastic expansion anchor bolts arranged parallelly in a longitudinal direction and a lateral direction is 200~450×200~450 mm, a number of said plastic expansion anchor bolts is more than 8 per square meter, a number of said plastic expansion anchor bolts in each vertical joint is more than 3, a spacing between said plastic expansion anchor bolts in said vertical joints is less than 400 mm, said plastic expansion anchor bolts are provided at four corners of said grid-reinforced rockwool insulation board, a diameter of said plastic expansion anchor bolt is more than 8 mm, a standard value of a tensile bearing capacity of a single anchor bolt is more than 0.6 KN, a diameter of said plastic disc platen having holes provided on said outer end portion of said plastic expansion anchor bolt is more than 60 mm, and an effective anchoring depth of said plastic expansion anchor bolt is more than 25 mm; and said base course wall is a concrete wall, an aerated concrete block wall, a solid brick wall, a hollow brick wall or a lightweight cement sand block wall.

2. The external insulation wall having grid-reinforced rockwool insulation board mechanically anchored, as recited in claim 1, wherein an optimum length of said grid-reinforced rockwool insulation board is 900~1600 mm, an optimum width of said grid-reinforced rockwool insulation board is 600~1200 mm, an optimum anchoring spacing between said plastic expansion anchor bolts arranged parallelly in said longitudinal direction and said lateral direction is 250~400×250~400 mm, an optimum diameter of said plastic disc platen having holes provided on said outer end portion of said plastic expansion anchor bolts is 65~95 mm, and an optimum effective anchoring depth of said plastic expansion anchor bolt is 35~45 mm.

3. An external insulation wall having grid-reinforced glass wool insulation board mechanically anchored, comprising: a base course wall, wherein a leveling and bonding layer, grid-reinforced glass wool insulation boards, plastic expansion anchor bolts, a thin plaster protecting layer, and a finishing layer are provided on said base course wall from inside to outside in turn;

a surface of said base course wall is applied with 3~9 mm thick polymer mortar as said leveling and bonding layer, and a leveling of said base course wall and an auxiliary bonding of said grid-reinforced glass wool insulation boards can be finished at one time to ensure a flatness of said grid-reinforced glass wool insulation boards;

then said grid-reinforced glass wool insulation boards are adhered to said base course wall, wherein grid reinforcers are provided in a surface layer of each grid-reinforced glass wool insulation board, and said surface layer with said grid reinforcers inside faces outwardly, so as to form a void-free insulation layer, said grid-reinforced glass wool insulation boards are rectangle boards paved in a lateral direction, vertical joints between said grid-reinforced insulation boards are staggered, and an optimum staggered vertical joint spacing is 300 mm or 400 mm;

then said grid-reinforced glass wool insulation boards are anchored with mechanical fixing devices, wherein said mechanical fixing devices are said plastic expansion anchor bolts, which means that holes are drilled on said grid-reinforced glass wool insulation boards for installing said plastic expansion anchor bolts, wherein a plastic disc platen having holes is provided on an outer end portions of each said plastic expansion anchor bolts, in such a manner that said grid-reinforced glass wool insulation board is directly fixed on said base course wall;

finally, said grid-reinforced insulation boards are plastered with said thin plaster protecting layer, said grid-reinforced insulation boards are covered with said plastic expansion anchor bolts, in such a manner that an insulating layer is protected, said thin plaster protecting layer is made of polymer anti-cracking mortar comprising a reinforcing mesh playing roles of crack-resistant, waterproof and impact resistance;

said grid-reinforced glass wool insulation board has a length of 800~2400 mm and a width of 400~1600 mm;

said plastic expansion anchor bolts are arranged on said grid-reinforced glass wool insulation boards and in joints between said grid-reinforced glass wool insulation boards, an anchoring spacing between said plastic expansion anchor bolts arranged parallelly in a longitudinal direction and a lateral direction is 200~450×200~450 mm, a number of said plastic expansion anchor bolts is more than 8 per square meter, a number of said plastic expansion anchor bolts in each vertical joint is more than 3, a spacing between said plastic expansion anchor bolts in said vertical joints is less than 400 mm, and said plastic expansion anchor bolts are provided at four corners of said grid-reinforced glass wool insulation board;

a diameter of said plastic expansion anchor bolt is more than 8 mm, a standard value of a tensile bearing capacity of a single anchor bolt is more than 0.6 KN, a diameter of said plastic disc platen having holes provided on said outer end portion of said plastic expansion anchor bolt is more than 60 mm, and an effective anchoring depth of said plastic expansion anchor bolt is more than 25 mm; and said base course wall is a concrete wall, an aerated concrete block wall, a solid brick wall, a hollow brick wall or a lightweight cement sand block wall.

4. The external insulation wall having grid-reinforced glass wool insulation board mechanically anchored, as recited in claim 3, wherein an optimum length of said grid-reinforced glass wool insulation board is 900~1600 mm, an optimum width of said grid-reinforced glass wool insulation board is 600~1200 mm, an optimum anchoring spacing between said plastic expansion anchor bolts arranged parallelly in said longitudinal direction and said lateral direction is 250~400×250~400 mm, an optimum diameter of said plastic disc platen having holes provided on said outer end portion of said plastic expansion anchor bolts is 65~95 mm, and an optimum effective anchoring depth of said plastic expansion anchor bolt is 35~45 mm.

5. An external insulation wall having grid-reinforced slag wool insulation board mechanically anchored, comprising: a base course wall, wherein a leveling and bonding layer, grid-reinforced slag wool insulation boards, plastic expansion anchor bolts, a thin plaster protecting layer, and a finishing layer are provided on said base course wall from inside to outside in turn;

a surface of said base course wall is applied with 3~9 mm thick polymer mortar as said leveling and bonding layer, and a leveling of said base course wall and an auxiliary bonding of said grid-reinforced slag wool insulation boards can be finished at one time to ensure a flatness of said grid-reinforced slag wool insulation boards;

then said grid-reinforced slag wool insulation boards are adhered to said base course wall, wherein grid reinforcers are provided in a surface layer of each grid-reinforced slag wool insulation board, and said surface layer with said grid reinforcers inside faces outwardly, so as to form a void-free insulation layer, said grid-reinforced slag wool insulation boards are rectangle boards paved in a lateral direction, vertical joints between said grid-reinforced insulation boards are staggered, and an optimum staggered vertical joint spacing is 300 mm or 400 mm;

then said grid-reinforced slag wool insulation boards are anchored with mechanical fixing devices, wherein said mechanical fixing devices are said plastic expansion anchor bolts, which means that holes are drilled on said grid-reinforced slag wool insulation boards for installing said plastic expansion anchor bolts, wherein a plastic disc platen having holes is provided on an outer end portions of each said plastic expansion anchor bolts, in such a manner that said grid-reinforced slag wool insulation board is directly fixed on said base course wall;

finally, said grid-reinforced insulation boards are plastered with said thin plaster protecting layer, said grid-reinforced insulation boards are covered with said plastic expansion anchor bolts, in such a manner that an insulating layer is protected, said thin plaster protecting layer is made of polymer anti-cracking mortar comprising a reinforcing mesh playing roles of crack-resistant, waterproof and impact resistance;

said grid-reinforced slag wool insulation board has a length of 800~2400 mm and a width of 400~1600 mm;

said plastic expansion anchor bolts are arranged on said grid-reinforced slag wool insulation boards and in joints between said grid-reinforced slag wool insulation boards, an anchoring spacing between said plastic expansion anchor bolts arranged parallelly in a longitudinal direction and a lateral direction is 200~450×200~450 mm, a number of said plastic expansion anchor bolts is more than 8 per square meter, a number of said plastic expansion anchor bolts in each vertical joint is more than 3, a spacing between said plastic expansion anchor bolts in said vertical joints is less than 400 mm, and said plastic expansion anchor bolts are provided at four corners of said grid-reinforced slag wool insulation board;

a diameter of said plastic expansion anchor bolt is more than 8 mm, a standard value of a tensile bearing capacity of a single anchor bolt is more than 0.6 KN, a diameter of said plastic disc platen having holes provided on said outer end portion of said plastic expansion anchor bolt is more than 60 mm, and an effective anchoring depth of said plastic expansion anchor bolt is more than 25 mm; and said base course wall is a concrete wall, an aerated concrete block wall, a solid brick wall, a hollow brick wall or a lightweight cement sand block wall.

6. The external insulation wall having grid-reinforced slag wool insulation board mechanically anchored, as recited in claim 5, wherein an optimum length of said grid-reinforced slag wool insulation board is 900~1600 mm, an optimum width of said grid-reinforced slag wool insulation board is 600~1200 mm, an optimum anchoring spacing between said plastic expansion anchor bolts arranged parallelly in said longitudinal direction and said lateral direction is 250~400×250~400 mm, an optimum diameter of said plastic disc platen having holes provided on said outer end portion of said plastic expansion anchor bolts is 65~95 mm, and an optimum effective anchoring depth of said plastic expansion anchor bolt is 35~45 mm.

7. An external insulation wall having grid-reinforced polyurethane insulation board mechanically anchored, comprising: a base course wall, wherein a leveling and bonding layer, grid-reinforced polyurethane insulation boards, plastic expansion anchor bolts, a thin plaster protecting layer, and a finishing layer are provided on said base course wall from inside to outside in turn;

a surface of said base course wall is applied with 3~9 mm thick polymer mortar as said leveling and bonding layer, and a leveling of said base course wall and an auxiliary bonding of said grid-reinforced polyurethane insulation boards can be finished at one time to ensure a flatness of said grid-reinforced polyurethane insulation boards;

then said grid-reinforced polyurethane insulation boards are adhered to said base course wall, wherein grid reinforcers are provided in a surface layer of each grid-reinforced polyurethane insulation board, and said surface layer with said grid reinforcers inside faces outwardly, so as to form a void-free insulation layer, said grid-reinforced polyurethane insulation boards are rectangle boards paved in a lateral direction, vertical joints between said grid-reinforced insulation boards are staggered, and an optimum staggered vertical joint spacing is 300 mm or 400 mm;

then said grid-reinforced polyurethane insulation boards are anchored with mechanical fixing devices, wherein said mechanical fixing devices are said plastic expansion anchor bolts, which means that holes are drilled on said grid-reinforced polyurethane insulation boards for installing said plastic expansion anchor bolts, wherein a plastic disc platen having holes is provided on an outer end portions of each said plastic expansion anchor bolts, in such a manner that said grid-reinforced polyurethane insulation board is directly fixed on said base course wall;

finally, said grid-reinforced insulation boards are plastered with said thin plaster protecting layer, said grid-reinforced insulation boards are covered with said plastic expansion anchor bolts, in such a manner that an insulating layer is protected, said thin plaster protecting layer is made of polymer anti-cracking mortar comprising a reinforcing mesh playing roles of crack-resistant, waterproof and impact resistance;

said grid-reinforced polyurethane insulation board has a length of 800~2400 mm and a width of 400~1600 mm;

said plastic expansion anchor bolts are arranged on said grid-reinforced polyurethane insulation boards and in joints between said grid-reinforced polyurethane insulation boards, a diameter of said plastic disc platen having holes provided on said outer end portion of said plastic expansion anchor bolt is more than 60 mm, and an effective anchoring depth of said plastic expansion anchor bolt is more than 25 mm;

an anchoring spacing between said plastic expansion anchor bolts arranged parallelly in a longitudinal direction and a lateral direction is 200~450×200~450 mm, said number of said plastic expansion anchor bolts is more than 8 per square meter, said number of said plastic expansion anchor bolts in each-vertical joint is more than 3, said spacing between said plastic expansion anchor bolts in said vertical joints is less than 400 mm, said plastic expansion anchor bolts are provided at said four corners of said grid-reinforced polyurethane insulation board, said diameter of said plastic expansion anchor bolt is more than 8 mm, said standard value of said tensile bearing capacity of said single anchor bolt is more than 0.6 KN, said diameter of said plastic disc platen having holes provided on said outer end portion of said plastic expansion anchor bolt is more than 60 mm, said effective anchoring depth of said plastic expansion anchor bolt is more than 25 mm; and said base course wall is a concrete wall, an aerated concrete block wall, a solid brick wall, a hollow brick wall or a lightweight cement sand block wall.

8. The external insulation wall having grid-reinforced polyurethane insulation board mechanically anchored, as recited in claim 7, wherein an optimum length of said grid-reinforced polyurethane insulation board is 900~1600 mm, and an optimum width of said grid-reinforced polyurethane insulation board is 600~1200 mm; and an optimum anchoring spacing between said plastic expansion anchor bolts arranged parallelly in said longitudinal direction and said lateral direction is 250~400×250~400 mm, an optimum diameter of said plastic disc platen having holes provided on said outer end portion of said plastic expansion anchor bolts is 65~95 mm, and an optimum effective anchoring depth of said plastic expansion anchor bolt is 35~45 mm.

9. An external insulation wall having grid-reinforced phenolic aldehyde insulation board mechanically anchored, comprising: a base course wall, wherein a leveling and bonding layer, grid-reinforced phenolic aldehyde insulation boards, plastic expansion anchor bolts, a thin plaster protecting layer, and a finishing layer are provided on said base course wall from inside to outside in turn;

a surface of said base course wall is applied with 3~9 mm thick polymer mortar as said leveling and bonding layer, and a leveling of said base course wall and an auxiliary bonding of said grid-reinforced phenolic aldehyde insulation boards can be finished at one time to ensure a flatness of said grid-reinforced phenolic aldehyde insulation boards;

then said grid-reinforced phenolic aldehyde insulation boards are adhered to said base course wall, wherein grid reinforcers are provided in a surface layer of each grid-reinforced phenolic aldehyde insulation board, and said surface layer with said grid reinforcers inside faces outwardly, so as to form a void-free insulation layer, said grid-reinforced phenolic aldehyde insulation boards are rectangle boards paved in a lateral direction, vertical joints between said grid-reinforced insulation boards are staggered, and an optimum staggered vertical joint spacing is 300 mm or 400 mm;

then said grid-reinforced phenolic aldehyde insulation boards are anchored with mechanical fixing devices, wherein said mechanical fixing devices are said plastic expansion anchor bolts, which means that holes are drilled on said grid-reinforced phenolic aldehyde insulation boards for installing said plastic expansion anchor bolts, wherein a plastic disc platen having holes is provided on an outer end portion of each said plastic expansion anchor bolts, in such a manner that said grid-reinforced phenolic aldehyde insulation boards are directly fixed on said base course wall;

finally, said grid-reinforced insulation boards are plastered with said thin plaster protecting layer, said grid-reinforced insulation boards are covered with said plastic expansion anchor bolts, in such a manner that an insulating layer is protected, said thin plaster protecting layer is made of polymer anti-cracking mortar comprising a reinforcing mesh playing roles of crack-resistant, waterproof and impact resistance;

said grid-reinforced phenolic aldehyde insulation board has a length of 800~2400 mm and a width of 400~1600 mm;

said plastic expansion anchor bolts are arranged on said grid-reinforced phenolic aldehyde insulation boards and in joints between said grid-reinforced phenolic aldehyde insulation boards, an anchoring spacing between said plastic expansion anchor bolts arranged parallelly in a longitudinal direction and a lateral direction is 200~450×200~450 mm, a number of said plastic expansion anchor bolts is more than 8 per square meter, a number of said plastic expansion anchor bolts in each vertical joint is more than 3, a spacing between said plastic expansion anchor bolts in said vertical joints is less than 400 mm, said plastic expansion anchor bolts are provided at four corners of said grid-reinforced phenolic aldehyde insulation board, a diameter of said plastic expansion anchor bolt is more than 8 mm, a standard value of a tensile bearing capacity of a single anchor bolt is more than 0.6 KN, a diameter of said plastic disc platen having holes provided on said outer end portion of said plastic expansion anchor bolt is more than 60 mm, an effective anchoring depth of said plastic expansion anchor bolt is more than 25 mm; and said base course wall is a concrete wall, an aerated concrete block wall, a solid brick wall, a hollow brick wall or a lightweight cement sand block wall.

10. The external insulation wall having grid-reinforced phenolic aldehyde insulation board mechanically anchored, as recited in claim 9, wherein an optimum length of said grid-reinforced phenolic aldehyde insulation board is 900~1600 mm, an optimum width of said grid-reinforced phenolic aldehyde insulation board is 600~1200 mm, an optimum anchoring spacing between said plastic expansion anchor bolts arranged parallelly in said longitudinal direction and said lateral direction is 250~400×250~400 mm, an optimum diameter of said plastic disc platen having holes provided on said outer end portion of said plastic expansion anchor bolts is 65~95 mm, and an optimum effective anchoring depth of said plastic expansion anchor bolt is 35~45 mm.

11. An external insulation wall having grid-reinforced modified expanded perlite insulation board mechanically anchored, comprising: a base course wall, wherein a leveling and bonding layer, grid-reinforced modified expanded perlite insulation boards, plastic expansion anchor bolts, a thin plaster protecting layer, and a finishing layer are provided on said base course wall from inside to outside in turn;

a surface of said base course wall is applied with 3~9 mm thick polymer mortar as said leveling and bonding layer, and a leveling of said base course wall and an auxiliary bonding of said grid-reinforced modified expanded perlite insulation boards can be finished at one time to ensure a flatness of said grid-reinforced modified expanded perlite insulation boards;

then said grid-reinforced modified expanded perlite insulation boards are adhered to said base course wall, wherein grid reinforcers are provided in a surface layer of each grid-reinforced modified expanded perlite insulation board, and said surface layer with said grid reinforcers inside faces outwardly, so as to form a void-free insulation layer, said grid-reinforced modified expanded perlite insulation boards are rectangle boards paved in a lateral direction, vertical joints between said grid-reinforced insulation boards are staggered, and an optimum staggered vertical joint spacing is 300 mm or 400 mm;

then said grid-reinforced modified expanded perlite insulation boards are anchored with mechanical fixing devices, wherein said mechanical fixing devices are said plastic expansion anchor bolts, which means that holes are drilled on said grid-reinforced modified expanded perlite insulation boards for installing said plastic expansion anchor bolts, wherein a plastic disc platen having holes is provided on an outer end portion of each said plastic expansion anchor bolts, in such a manner that said grid-reinforced modified expanded perlite insulation boards are directly fixed on said base course wall;

finally, said grid-reinforced insulation boards are plastered with said thin plaster protecting layer, said grid-reinforced insulation boards are covered with said plastic expansion anchor bolts, in such a manner that an insulating layer is protected, said thin plaster protecting layer is made of polymer anti-cracking mortar comprising a reinforcing mesh playing roles of crack-resistant, waterproof and impact resistance;

said grid-reinforced modified expanded perlite insulation board has a length of 800~2400 mm and a width of 400~1600 mm;

said plastic expansion anchor bolts are arranged on said grid-reinforced modified expanded perlite insulation boards and in joints between said grid-reinforced modified expanded perlite insulation boards, an anchoring spacing between said plastic expansion anchor bolts arranged parallelly in a longitudinal direction and a lateral direction is 200~450×200~450 mm, a number of said plastic expansion anchor bolts is more than 8 per square meter, a number of said plastic expansion anchor bolts in each-vertical joint is more than 3, a spacing between said plastic expansion anchor bolts in said vertical joints is less than 400 mm, said plastic expansion anchor bolts are provided at four corners of said grid-reinforced modified expanded perlite insulation board, a diameter of said plastic expansion anchor bolt is more than 8 mm, a standard value of a tensile bearing capacity of a single anchor bolt is more than 0.6 KN, a diameter of said plastic disc platen having holes provided on said outer end portion of said plastic expansion anchor bolt is more than 60 mm, an effective anchoring depth of said plastic expansion anchor bolt is more than 25 mm; and said base course wall is a concrete wall, an aerated concrete block wall, a solid brick wall, a hollow brick wall or a lightweight cement sand block wall.

12. The external insulation wall having grid-reinforced modified expanded perlite insulation board mechanically anchored, as recited in claim 11, wherein an optimum length of said grid-reinforced modified expanded perlite insulation board is 900~1600 mm, an optimum width of said grid-reinforced modified expanded perlite insulation board is 600~1200 mm, an optimum anchoring spacing between said plastic expansion anchor bolts arranged parallelly in said longitudinal direction and said lateral direction is 250~400×250~400 mm, an optimum diameter of said plastic disc platen having holes provided on said outer end portion of said plastic expansion anchor bolts is 65~95 mm, and an optimum effective anchoring depth of said plastic expansion anchor bolt is 35~45 mm.

* * * * *